US005826487A

United States Patent [19]

A'Hearn

[11] Patent Number: 5,826,487

[45] Date of Patent: Oct. 27, 1998

[54] PRESSURE CONTROL FOR A PAIR OF PARALLEL HYDRAULIC CIRCUITS

[75] Inventor: Michael A. A'Hearn, Shorewood, Ill.

[73] Assignee: Caterpillar Inc., Peoria, Ill.

[21] Appl. No.: 803,347

[22] Filed: Feb. 20, 1997

[51] Int. Cl.[6] ..... F15B 11/00

[52] U.S. Cl. ..... 91/516; 91/532; 60/413

[58] Field of Search ..... 91/511, 514, 517, 91/516, 532; 60/413

[56] References Cited

U.S. PATENT DOCUMENTS

| | | | |
|---|---|---|---|
| 3,811,363 | 5/1974 | Cryder | 91/412 |
| 3,994,133 | 11/1976 | Pfeil et al. | 91/516 X |
| 4,337,620 | 7/1982 | Johnson | 60/418 |
| 4,635,439 | 1/1987 | Wible | 60/420 |
| 4,966,066 | 10/1990 | Kauss et al. | 91/516 |
| 5,072,802 | 12/1991 | Tischer | 91/516 X |
| 5,179,835 | 1/1993 | Casey et al. | 91/516 X |

*Primary Examiner*—Hoang Nguyen
*Attorney, Agent, or Firm*—John W. Grant; J. W. Burrows

[57] ABSTRACT

An unloader valve is connected to a pump and has first and second ends, a priority flow port communicating with the first end and being connected to a first conduit connected to a first hydraulic circuit, an excess flow port communicating with a tank, and a spring disposed at the second end biasing the unloader valve to a priority flow position with a force sufficient to maintain the pressure in the priority flow port above a predetermined minimum level. The unloader valve is biased toward an unloading position in opposition to the spring force by pressure generated force acting on the second end. A check valve is disposed between the first conduit and a second conduit connected to a second hydraulic circuit. A valve device controls the pressure at the second end of the unloader valve in response to pressure in the second conduit so that pressure in the second conduit is maintained above a second higher predetermined level.

8 Claims, 2 Drawing Sheets

PRESSURE CONTROL FOR A PAIR OF PARALLEL HYDRAULIC CIRCUITS

TECHNICAL FIELD

This invention relates generally to a hydraulic system having a pair of parallel hydraulic circuits and, more particularly, to a pressure control for maintaining pressure greater than a predetermined level in one of the hydraulic circuits.

BACKGROUND ART

Many hydraulic systems have a pair of hydraulic circuits connected to a common source of fluid such as a pump. Some of such systems also have a pressure compensated priority flow control valve which provides priority flow to one of the hydraulic circuits with any unused flow made available to the other circuit. One such hydraulic system is used on a mobile machine and has a steering circuit and a brake circuit. Typically, the requirements for the steering function is primarily flow related at variable pressures while the requirements for the braking function is primarily pressure related at very low flow. The steering circuit is a pressure compensated hydraulic circuit connected to the priority flow port of the priority flow control valve and the brake circuit is a nonpressure compensated hydraulic circuit connected to the excess flow port of the priority valve so that the steering circuit has priority flow over the brake circuit.

One of the problems encountered with that hydraulic system is that the total output of the pump passes through the brake valve to the tank wherein brake pressure is generated by controllably blocking fluid flow through the brake valve. This not only increases the size of the brake valve and thus the cost therefore, but compromises the performance of the brake circuit.

Thus, in view of the above, it is desirable to provide a simple hydraulic system that ensures that brake pressure requirements are satisfied regardless of the flow and/or pressure demands of the steering circuit and to achieve better performance at less cost.

The present invention is directed to overcoming one or more of the problems as set forth above.

DISCLOSURE OF THE INVENTION

In one aspect of the present invention, a pressure control for a hydraulic system has a pump connected to a tank, a first pressure compensated hydraulic circuit, and a second hydraulic circuit. The first circuit includes a conduit and a flow control valve connected to the conduit and having a neutral flow blocking position, a tank port connected to the tank, and a load signal port communicating with the tank port at the neutral position. The second circuit is connected to the first conduit in parallel with the first hydraulic circuit and includes a second conduit connected to the first conduit and a pressure control valve connected to the second conduit. The pressure control includes an unloader valve connected to the pump and having first and second ends, a priority flow port connected to the first conduit and communicating with the first end, an excess flow port communicating with the tank, and a spring disposed at the second end resiliently biasing the unloader valve to a priority flow position with a force sufficient to maintain the pressure in the priority flow port above a predetermined minimum level. The unloader valve is biased toward an unloading position in opposition to the spring force by pressure generated force acting on the second end. A check valve is disposed between the first and second conduits. A valve device controls the pressure at the second end of the unloader valve in response to pressure in the second conduit so that pressure in the second conduit is maintained above a second higher predetermined level.

BEST MODE FOR CARRYING OUT THE INVENTION

Figure 1:
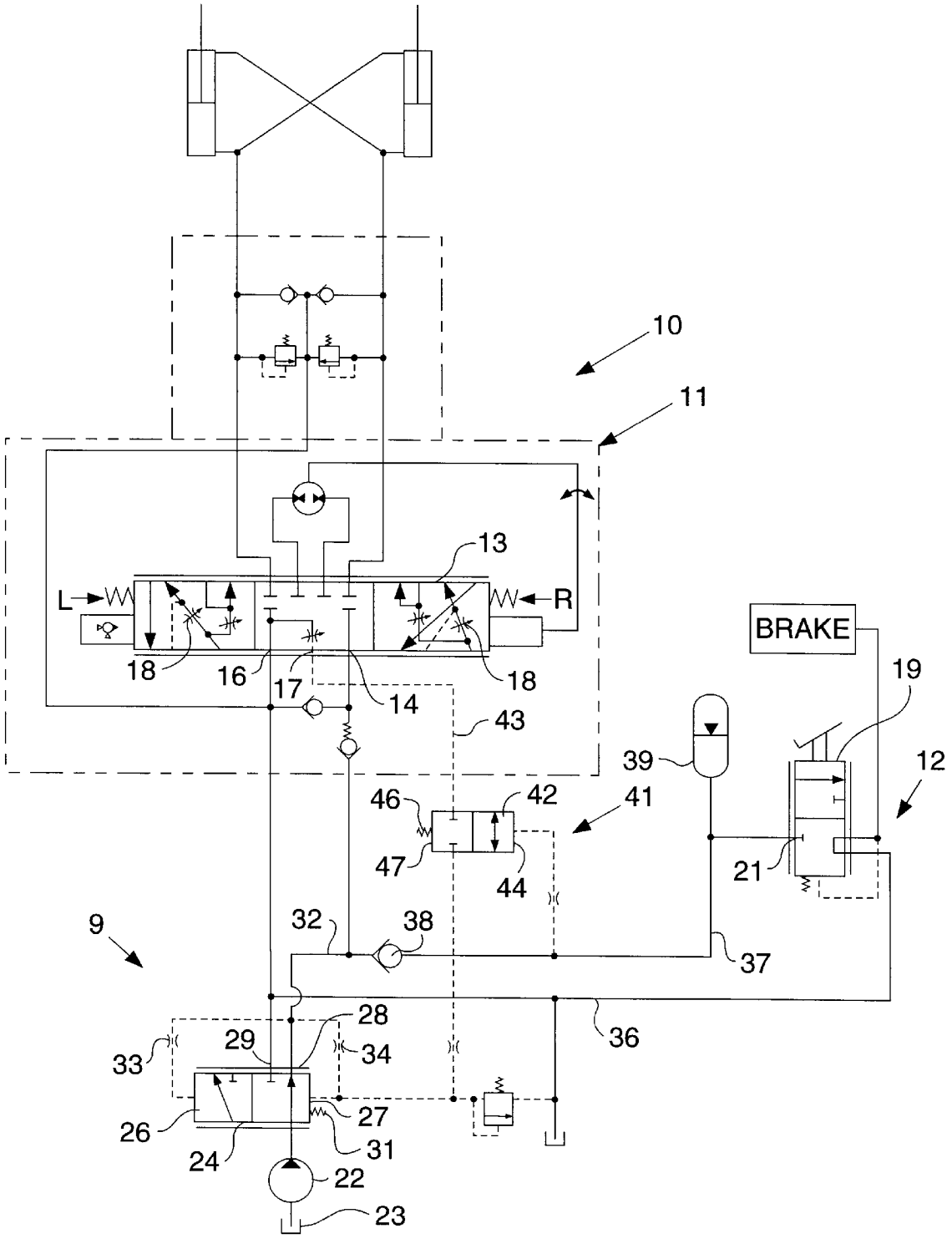
FIG. 1 is a schematic illustration of an embodiment of the present invention.

FIG. 1 illustrates a pressure control 9 in combination with a hydraulic system 10 that includes a pair of hydraulic circuits 11,12. The hydraulic circuit 11 is a pressure compensated power steering circuit and includes a flow control steering valve 13 of the type commonly referred to as an HMU. The steering valve 13 has a supply port 14, a tank port 16 and a load signal port 17 that communicates with the tank port 16 at the neutral position shown. Shifting the steering valve 13 from the neutral position to either the left turn position L or the right turn position R defines a main variable flow control orifice 18. The steering valve, in a manner well known in the art, blocks the signal port from the tank port and communicates a load pressure signal taken from downstream of the variable flow control orifice 18 with the signal port 17. The hydraulic circuit 12 is a nonpressure compensated brake circuit including a pressure control brake valve 19 having a supply port 21. The hydraulic system also includes a fixed displacement pump 22 connected to a tank 23.

The pressure control 9 includes a pressure compensated unloader valve 24 connected to the pump 22. The unloader valve has opposite ends 26,27, a priority flow port 28, an excess flow port 29 and a spring 31 biasing the unloader valve to a priority flow position shown at which the pump communicates with the priority flow port. The priority flow port communicates with the end 26 through a flow dampening orifice 33 and with the end 27 through a flow restricting orifice 34 and is connected to a conduit 32. The excess flow port 29, the tank port 16 of the steering valve 13 and the brake valve 19 are connected to the tank 23 through a common exhaust conduit 36. Another conduit 37 connects the conduit 32 with the supply port 21 of the brake valve 19 through a check valve 38. An accumulator 39 is connected to the conduit 37.

The biasing force of the spring 31 is selected to bias the unloader valve 24 to the priority flow position with a force sufficient to maintain the pressure in the priority flow port above a predetermined minimum level. The unloader valve is biased toward an unloading position communicating the pump with the excess port 29 in opposition to the force of the spring 31 by a pressure generated force acting on the end 26.

The pressure control 9 also includes a valve means 41 for controlling the pressure at the end 27 of the unloader valve 24 in response to pressure in the conduit 37 so that pressure in the conduit 37 is maintained above a second higher predetermined level.

The valve means 41 of the embodiment of FIG. 1 includes a two position, two way pressure control valve 42 disposed in a signal line 43 connected to the signal port 17 and to the end 27 of the unloader valve 24. An end 44 of the pressure control valve communicates with the conduit 37. A spring 46 disposed at the other end 47 biases the pressure control valve to the closed signal blocking position shown until the pressure in the supply conduit 37 exceeds the second higher predetermined level.

Figure 2:
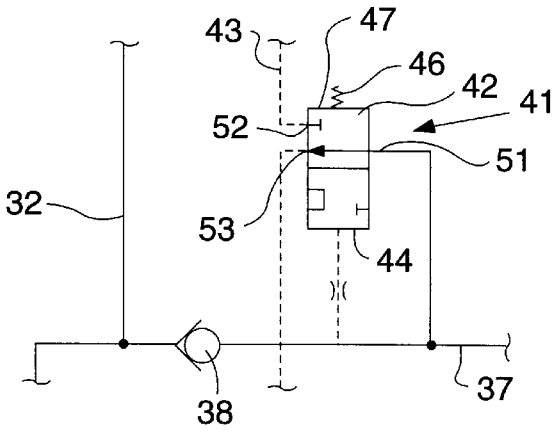
FIGS. 2, 3 and 4 are partial schematic views of alternate embodiments of the present invention of FIG. 1.

Referring to the embodiment of FIG. 2, the valve means 41 includes a two position, three way pressure control valve 42 having an inlet port 51 connected to the conduit 37 and a pair of signal control ports 52,53 respectively connected to the signal port 17 of the steering valve 13 and the end 27 of the unloader valve 24. The spring 46 biases the pressure control valve 42 to the position shown until the pressure in the conduit 37 exceeds the second predetermined pressure level. In the position shown, the pressure control valve 42 blocks the signal port 17 from the end 27 and directs pressurized fluid from the conduit 37 to the end 27. Movement of the pressure control valve 42 to its second position blocks fluid flow from the conduit 37 and communicates the signal port 17 with the end 27.

Figure 3:
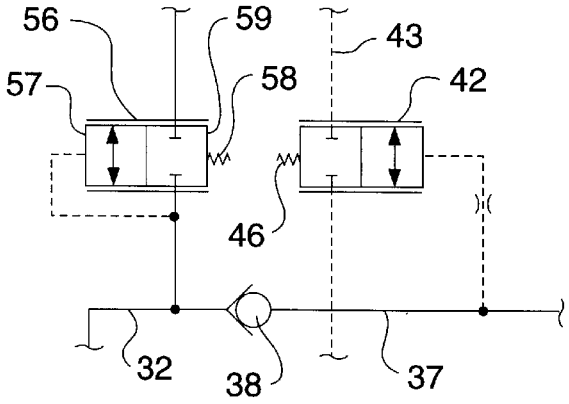

FIG. 3 discloses a flow priority valve 56 in combination with the valve means 41. The flow priority valve 56 in this embodiment is a two position, two way valve disposed to control fluid flow through the conduit 32 to the steering valve. One end 57 of the flow priority valve 56 communicates with the conduit 32 upstream of the flow priority valve. A spring 58 disposed at the other end 59 biases the flow priority valve to the closed flow blocking position shown until the pressure at the end 57 exceeds a third predetermined level which is between the first and second predetermined levels.

Figure 4:
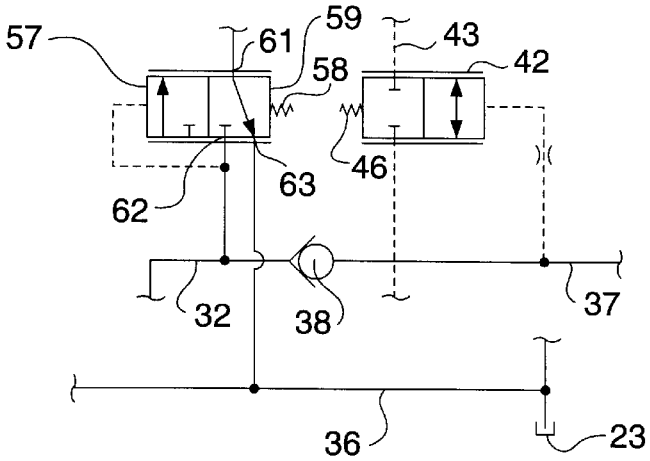

In FIG. 4, the flow priority valve 56 is a two position, three way valve having a first port 61 connected to the supply port 14 of the steering valve 13, a second port 62 connected to the conduit 32 and a third port 63 connected to the exhaust conduit 36. The spring 58 biases the flow priority valve 56 to the position shown at which the first port 61 communicates with the exhaust conduit via the third port 63 and is blocked from the second port 62. The flow priority valve 56 is moved to its second position when the fluid pressure at the end 57 exceeds the third predetermined level. At the second position of the flow priority valve, the first port 61 communicates with the second port 62 and is blocked from the third port 63.

Alternatively, the two position, three way valve 42 shown in FIGS. 3 or 4 may be replaced with the two position, three way valve 42 shown in FIG. 1.

Industrial Applicability

By way of example only, it will be assumed for purposes of the subsequent description that the fixed displacement pump is sized to handle the requirements of both the steering and brake circuits, that the spring 31 of the loader valve 24 exerts a biasing force equivalent to a fluid pressure of 1000 kPa, i.e. the first predetermined pressure level, that the spring 46 of the pressure control valve 42 exerts a biasing force equivalent to a fluid pressure of 6900 kPa, i.e. the second predetermined pressure level, and that the spring 58 of the flow priority valve 56 exerts a biasing force equivalent to a fluid pressure of 6200 kPa, i.e. the third predetermined pressure level.

Initially, the total output of the pump 22 passes through the priority flow port 28 into the conduit 32. With the supply port 14 of the steering valve 13 blocked, the check valve 38 is immediately opened to communicate the conduit 32 with the conduit 37. With the supply port 21 of the brake valve 19 blocked, the accumulator 39 begins to be filled thereby causing an increase in pressure in the conduits 32 and 37. With the pressure control valve 42 initially being in its blocking position, the increasing pressure in the conduit 32 is subjected to both ends 26,27 of the unloader valve 24 so that the spring 31 maintains the unloader valve in the priority flow position shown.

However, once the fluid pressure in the conduit 37 reaches the 6900 kPa level, the pressure control valve 42 moves leftward communicating the end 27 with the exhaust conduit 36 through the signal line 43, the signal port 17 and the exhaust port 16. The resulting fluid flow through the orifice 34 reduces the pressure at the end 27 of the unloader valve permitting the fluid generated pressure acting on the end 26 to move the unloader valve 24 rightward. In this mode because the biasing force of the spring 31 is 1000 kPa, the unloader valve 24 will provide only sufficient flow of fluid from the pump 22 to the priority flow port 28 to maintain the pressure in the conduit 32 at the 1000 kPa level. The check valve 38 blocks reverse flow through the conduit 37 and thus maintains the pressure in the conduit 37 at the 6900 kPa level.

Assume now that the brake valve 19 is moved downwardly to apply the brakes and the pressure in the conduit 37 decreases below the 6900 kPa level. When this happens, the spring 46 moves the pressure control valve 42 to its flow blocking position. This blocks fluid flow through the signal line 43 resulting in the unloader valve 24 being moved leftward to again direct a greater flow into the conduits 32,37. The pressure control valve 42 will permit only sufficient fluid flow through the orifice 34 to maintain the fluid pressure in the conduit 37 at the 6900 kPa level.

Assume now that the steering valve 13 is actuated under the conditions described above at which the fluid pressure in the conduit 37 is at the 6900 kPa level, the pressure control valve 42 is at its leftward position communicating the end 27 with the exhaust conduit 36 and the fluid pressure in the conduit 32 is at the 1000 kPa level. Shifting the steering valve 13 in either direction blocks communication between the signal port 17 and the tank port 16 and directs a load pressure signal downstream of the main flow control orifice 18 through the signal line 43 to the end 27 of the unloader valve. If the pressure in the conduit 37 remains at or above 6900 kPa, the unloader valve 24 will shift sufficiently to provide a sufficient flow of fluid to the supply port 14 of the steering valve to maintain a pressure drop of approximately 1000 kPa across the variable flow control orifice 18. If the fluid pressure in the conduit 32 should become greater than the fluid pressure in the conduit 37, the check valve 38 will open and the accumulator 39 will simply be charged to the greater pressure level.

If both the steering valve and the brake valve 19 are actuated simultaneously, the pressure control valve 42 will function to control the pressure at the end 27 of the unloader valve to maintain the pressure in the conduit 37 at or above the 6900 kPa level.

The two position, three way pressure control valve 42 of the FIG. 2 embodiment also controls the pressure at the end 27 of the unloader valve 24 but in a slightly different manner. More specifically, when the pressure control valve 42 is in the position shown, pressurized fluid from the conduit 37 is directed to the end 27 of the unloader valve 24 until the pressure in the conduit 37 exceeds 6900 kPa. At this point, the pressure control valve 42 moves upward to establish communication through the signal line 43 between the end 27 and the signal port 17 of the steering valve. As described above, the unloader valve then shifts rightward to provide only sufficient flow of fluid to the conduit 32 to maintain the pressure therein at the 1000 kPa level.

The function of the pressure control valve 42 of the FIG. 3 embodiment functions identical to that described in conjunction with FIG. 1. In this embodiment, however, the priority flow control valve 56 blocks fluid flow through the conduit 32 thereby providing flow priority to the brake circuit 12 until the fluid pressure in the conduit 32 upstream of the priority flow control valve 56 exceeds the 6200 kPa level. When that pressure is reached, the priority flow control valve 56 moves rightward to establish communication through the conduit 32 to the supply port 14 of the steering valve. Thus, the pressure control valve 42 provides pressure priority of 6900 kPa to the brake control circuit 12 while the flow priority valve 56 provides flow priority until the pressure exceeds the 6200 kPa level.

The embodiment of FIG. 4 functions essentially as described above in regard to the embodiment of FIG. 3 with the exception that the two position, three way flow priority valve 56 communicates the downstream portion of the conduit 32 with the exhaust conduit 36 at the spring biased position shown.

Other aspects, objects and advantages of this invention can be obtained from a study of the drawings, the disclosure and the appended claims.

I claim:

1. A pressure control for a hydraulic system having a tank, a pump connected to the tank, a first pressure compensated hydraulic circuit, and a second hydraulic circuit, the first circuit including a conduit and a flow control valve connected to the conduit and having a neutral flow blocking position, and the second circuit being connected to the first conduit in parallel with the first hydraulic circuit and including a second conduit connected to the first conduit and a pressure control valve connected to the second conduit to control pressure in the second hydraulic circuit, the pressure control comprising:

an unloader valve connected to the pump and having first and second ends, a priority flow port connected to the first conduit and communicating with the first end, an excess flow port communicating with the tank, and a spring disposed at the second end biasing the unloader valve to a priority flow position with a force sufficient to maintain the pressure in the priority flow port above a first predetermined minimum level, the unloader valve being biased toward an unloading position in opposition to the spring force by a pressure generated force at the second end;

a check valve disposed between the first and second conduits; and valve means for controlling the pressure at the second end of the unloader valve in response to pressure in the second conduit so that pressure in the second conduit is maintained above a second predetermined level that is greater than the first predetermined level.

2. The pressure control of claim 1 wherein the flow control valve has a tank port connected to the tank and a load signal port communicating with the tank port at the neutral position of the flow control valve, and the valve means includes a pressure control valve connected to the load signal port and to the second end of the unloader valve and having a first end communicating with the second conduit, a second end and a spring disposed at the second end biasing the pressure control valve of the valve means to a position blocking the load signal port from the second end of the unloader valve until the pressure in the second conduit exceeds the second predetermined level.

3. The pressure control of claim 2 wherein the pressure control valve of the valve means is moved to another position to communicate the load signal port with the second end when the pressure in the second conduit exceeds the second predetermined level.

4. The pressure control of claim 3 wherein the unloader valve includes an orifice communicating the first conduit with the second end of the unloader valve, and the pressure control valve of the valve means is a two position, two way valve disposed between the load signal port and the second end of the unloader valve for blocking the load signal port from the second end at its first position and for communicating the load signal port with the second end of the unloader valve at its second position.

5. The pressure control of claim 3 wherein the pressure control valve of the valve means is a two position, three way valve having a first port connected to the second conduit, a second port connected to the to the load signal port and a third port connected to the second end of the unloader valve with the first port communicating with the second end at one position of the pressure control valve of the valve means.

6. The pressure control of claim 5 wherein the load signal port communicates with the second end of the unloader valve at the second position of the pressure control valve of the valve means.

7. The pressure control of claim 3 including a priority flow control valve disposed between the priority flow port and the supply port of the flow control valve and having a closed flow blocking position and an open flow communicating position, a first end communicating with the first conduit upstream of the priority flow control valve, a second end, and a spring disposed at the second end of the priority flow control valve biasing the priority flow control valve to the closed position until the pressure in the priority flow port exceeds a third predetermined level which is less than the second predetermined level.

8. The pressure control of claim 3 including an accumulator connected to the first conduit downstream of the check valve.

* * * * *